United States Patent [19]

Bennett

[11] Patent Number: 5,042,814

[45] Date of Patent: Aug. 27, 1991

[54] INSTRUCTIONAL BALL HITTING DEVICE

[76] Inventor: Joseph M. Bennett, 9 Victorian La., Brookville, N.Y. 11545

[21] Appl. No.: 583,793

[22] Filed: Sep. 17, 1990

[51] Int. Cl.[5] ..... A63B 69/36

[52] U.S. Cl. ..... 273/183 A; 273/183 E; 273/186 R; 273/184 B

[58] Field of Search ..... 273/183 R, 183 A, 183 E, 273/184 B, 185 C, 185 D, 186 R, 190 R

[56] References Cited

U.S. PATENT DOCUMENTS

| | | | |
|---|---|---|---|
| 1,842,944 | 1/1932 | O'Brien | 273/183 C |
| 2,149,174 | 2/1939 | Johnson | 273/186 R |
| 2,152,381 | 3/1939 | Harpster | 273/186 R |
| 3,101,949 | 8/1963 | Williams | 273/186 R |
| 3,107,920 | 10/1963 | Strunk | 273/186 R |
| 3,194,565 | 7/1965 | Schroer | 273/186 R |
| 3,429,577 | 2/1969 | Godden | 273/186 R |
| 3,741,550 | 6/1973 | Landures | 273/186 R |
| 4,223,891 | 9/1980 | Gaasbeek | 273/186 R |
| 4,526,373 | 7/1985 | Medlock | 273/186 R |
| 4,577,868 | 3/1986 | Kiyonaga | 273/183 A |
| 4,732,390 | 3/1988 | McCollum | 273/186 R |
| 4,786,057 | 11/1988 | Brown | 273/186 R |
| 4,826,174 | 5/1989 | Hoyt, Jr. | 273/186 R |
| 4,913,440 | 4/1990 | Ellington | 273/186 R |
| 4,963,314 | 10/1990 | Gering et al. | 273/183 A |

FOREIGN PATENT DOCUMENTS

| | | | |
|---|---|---|---|
| 418045 | 11/1934 | United Kingdom | 273/186 R |
| 1216031 | 12/1970 | United Kingdom | 273/183 A |
| 1295471 | 11/1972 | United Kingdom | 273/186 R |

*Primary Examiner*—George J. Marlo
*Attorney, Agent, or Firm*—Hoffmann & Baron

[57] ABSTRACT

The present invention is directed to an instructional ball hitting device which is designed to actively train the golfer to properly execute portions of his swing. According to one embodiment of the present invention, a ball support in the form of a golf tee is arranged in electrical communication with an indicator and a timer. When the golfer strikes the support with his club, a signal is transmitted from the support member to activate the indicator. According to this embodiment, the timer deactivates the indicator after a predetermined time period. The indicator is designed to train the golfer to keep his head down and his eyes focused on or near the ball support until the indicator has been deactivated. According to another embodiment, the speed of the golfer's backswing is measured by measuring the time period between contact of the clubhead and the two detectors. Various indicators are useful to indicate to the golfer whether his backswing is being executed at a proper speed.

18 Claims, 3 Drawing Sheets

INSTRUCTIONAL BALL HITTING DEVICE

The present invention is directed to an athletic training device and, more particularly, to an instructional ball hitting device.

BACKGROUND OF THE INVENTION

The popularity of the game of golf has lead to the development of a wide variety of practice devices. Most practice devices previously disclosed are designed to provide the golfer with some indication of whether he has executed a proper stroke. Included among these known devices are golf balls which explode if contacted at the right point.

Also disclosed are a wide variety of mats containing moveable pins which are either placed adjacent the intended clubhead path or directly within the intended clubhead path. Some of these previously disclosed devices have connected the moveable pins to bells such that the golfer is given an audible indication. Other known practice golf mats simply have moveable pins which are initially arranged in a vertical position but are knocked down upon contact with a golf head thus providing the golfer with a post swing indication of which pins he has contacted. As most of the known devices simply provide the golfer with an indication of the path of his clubhead after he has executed his swing, these devices fail to provide the golfer with any positive feedback during the execution of his swing and, in this sense, fail to actively train the golfer to properly execute various stages of the swing.

It would, therefore, be very helpful to provide a golfer with a device which actively provides indications to him during various stages of his swing. This biofeedback would permit the golfer to analyze various stages of his swing during its execution.

SUMMARY OF THE INVENTION

The present invention is directed to an instructional golf device which is designed to actively train the golfer to properly execute critical portions of his swing. According to one embodiment of the present invention, the device is in the form of a mat comprising a ball support, generally in the form of a golf tee, arranged in electrical communication with an indicator, e.g. a light, and a timer. When the golfer strikes the ball support with his clubhead a signal is transmitted from the ball support to the indicator to turn on the light. According to this embodiment the timer extinguishes the light after a predetermined time period, for example, one second. The light in this embodiment is specifically designed to train the golfer to keep his head down and eyes focused on or near the ball support until the light has been extinguished. If the golfer maintains eye contact with the illuminated indicator until it is extinguished, he is assured that he has kept his head down for a sufficient period of time. As described in further detail below, various types of signals may be provided to the golfer.

According to another embodiment of the present invention, the ball support is positioned forwardly of two clubhead detectors. One detector is placed relatively close to the ball support leaving only slightly more room than is necessary for a clubhead to be comfortably positioned between the ball support and first detector. This first detector is coupled to an electrical circuit whereby a signal is generated when the golfer commences his backswing. The second detector is positioned some distance back from the first detector and is also designed to generate a signal in response to contact from the clubhead. By measuring the time period between contact of the clubhead and each of the two detectors, the speed of the golfer's backswing may be measured. Various indicators are useful to indicate to the golfer whether his backswing is being executed at a proper speed or at the golfer's desired speed.

These and other embodiments of the present invention are described in further detail below.

DETAILED DESCRIPTION

Figure 1:
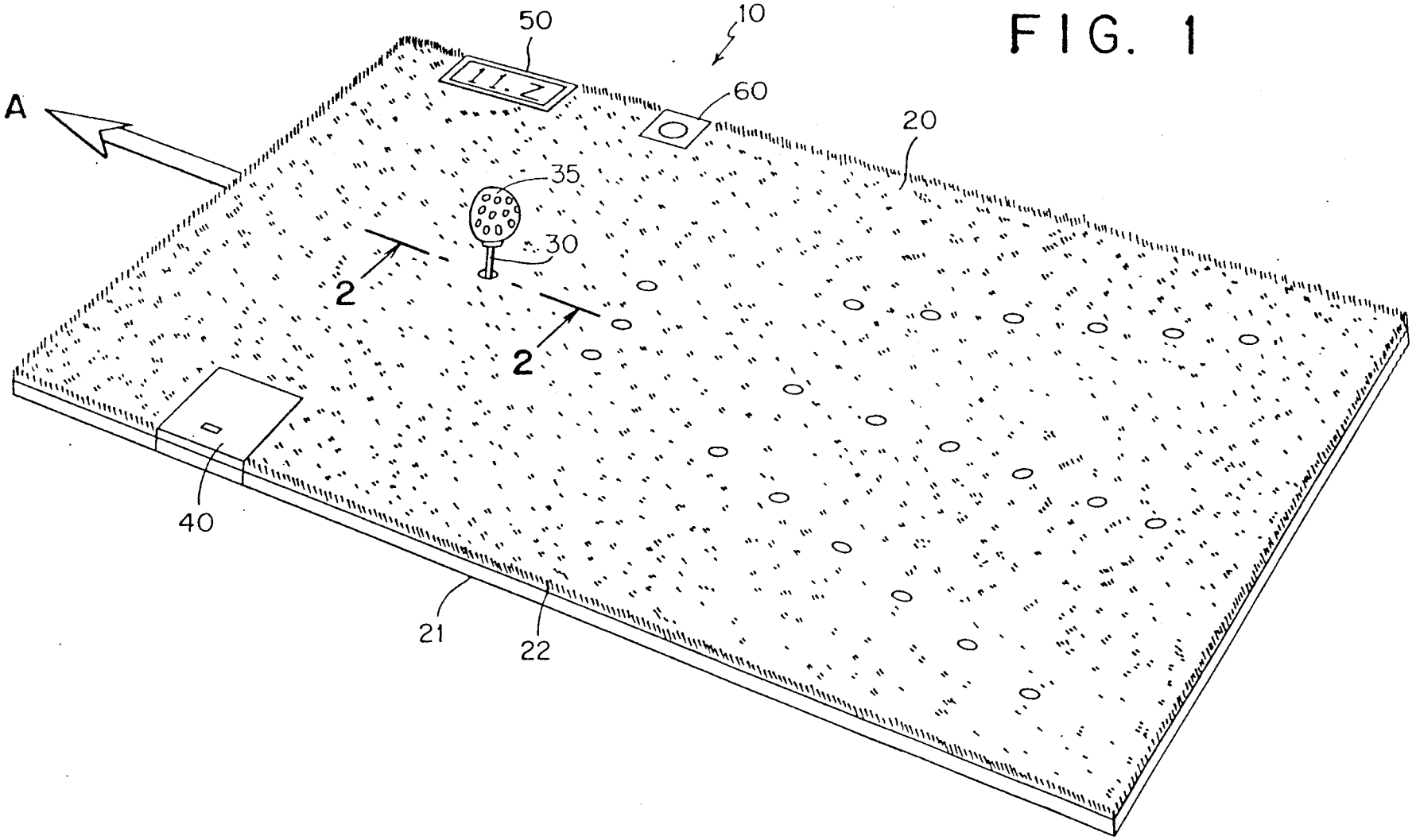
FIG. 1 is a perspective view of one embodiment of the present invention.

The present invention advantageously provides a golfer with biofeedback during the execution of his swing in order to actively assist the golfer in executing a proper swing. According to one embodiment of the present invention illustrated in FIG. 1, the instructional golf device 10 is in the form of an instructional golf mat. Instructional device 10 comprises a mat 20 having a base 21 formed of a durable, resilient material, such as plastic, and a second layer 22 of some form of artificial turf. Those skilled in the art will appreciate that various materials may be utilized in forming the mat 20 of the present invention without departing from the scope of the present invention.

A ball support 30 is centrally located toward the forward end of mat 20. As used herein, the terms forwardly and rearwardly are used as a point of reference wherein the term forwardly is meant to indicate the intended direction of a golf ball as indicated by the arrow A in FIG. 1. Ball support 30 may be in the shape of a conventional golf tee adapted to support a golf ball. Alternatively, the top of ball support 30 may be provided with a threaded recess as illustrated in FIG. 2 in order to securely receive a "dummy" golf ball 31 having a threaded projection 32. In this manner, a golfer may use instructional golf mat 10 outdoors, for example at a driving range, with real balls or he may use the dummy ball 31 for practice in a confined area. Those skilled in the art will appreciate that the upper portion of ball support 30 and dummy golf ball 31 may be formed of rubber or some other impact-resistant material which will not mar a clubhead.

With reference to FIG. 2 which is a cross-sectional view of ball support 30 of this embodiment of the present invention, the ball support 30 functions as a moveable switch element. As illustrated, mat 20 is provided with a forward contact 33 disposed in space proximity to a cooperating support contact 34 disposed on the stem of ball support 30. It will be appreciated by those skilled in the art that when a golfer strikes ball support 30 during execution of his swing, electrical contact will result between forward contact 33 and support contact 34. This contact transmits an electrical signal which is useful for reasons described in further detail below.

According to this illustrated embodiment, mat 20 is also provided with an indicator in the form of a light. The light is connected to a power source 40, a timer 50 and the switching elements of ball support 30. Furthermore, a conventional push button switch (not illustrated) may be provided to control the supply of power to this switching circuit.

Figure 2:
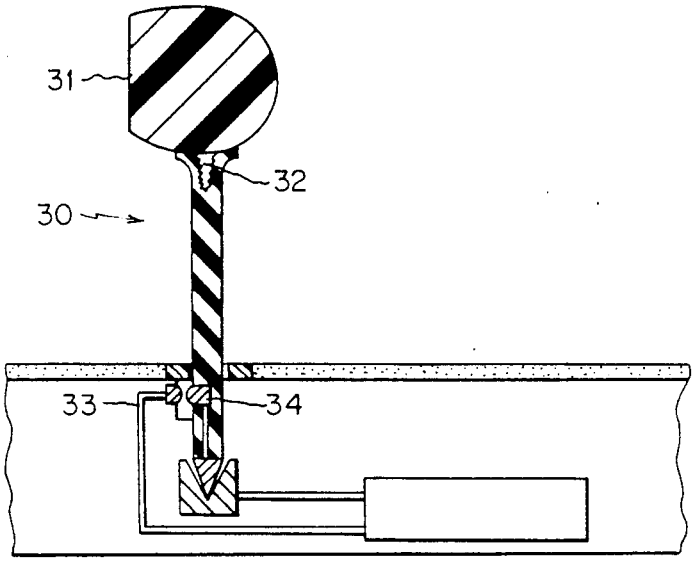
FIG. 2 is a cross sectional view along line 2—2 of FIG. 1.

The embodiment of the present invention illustrated in FIGS. 1 and 2 is specifically designed to train a golfer to keep his head down during the execution of his swing. When a golfer strikes support member 30 during his swing, the electrical signal generated by the contact of forward contact 33 and support contact 34 illuminates light indicator 60 for a predetermined period of time which is controlled by timer 50. The length of the predetermined time period may be controlled by providing timer 50 with a control mechanism. After the expiration of the predetermined time period, the light in indicator 60 is extinguished indicating to the golfer that he may turn his head in order to continue his follow-through and to watch his ball.

The length of time that light indicator 60 continues to provide a visual signal may be varied for different golfers by providing timer 50 with a control mechanism. For example, one golfer may desire a time period of about one-half second while another golfer may desire to keep his head down for about one second. The advantages of the present invention may be realized using a range of time periods.

According to one preferred embodiment of the present invention, the bulb in light indicator 60 advantageously flashes rapidly when light indicator 60 is activated in order to more dramatically retain the golfers attention for the desired time period.

Figure 4:
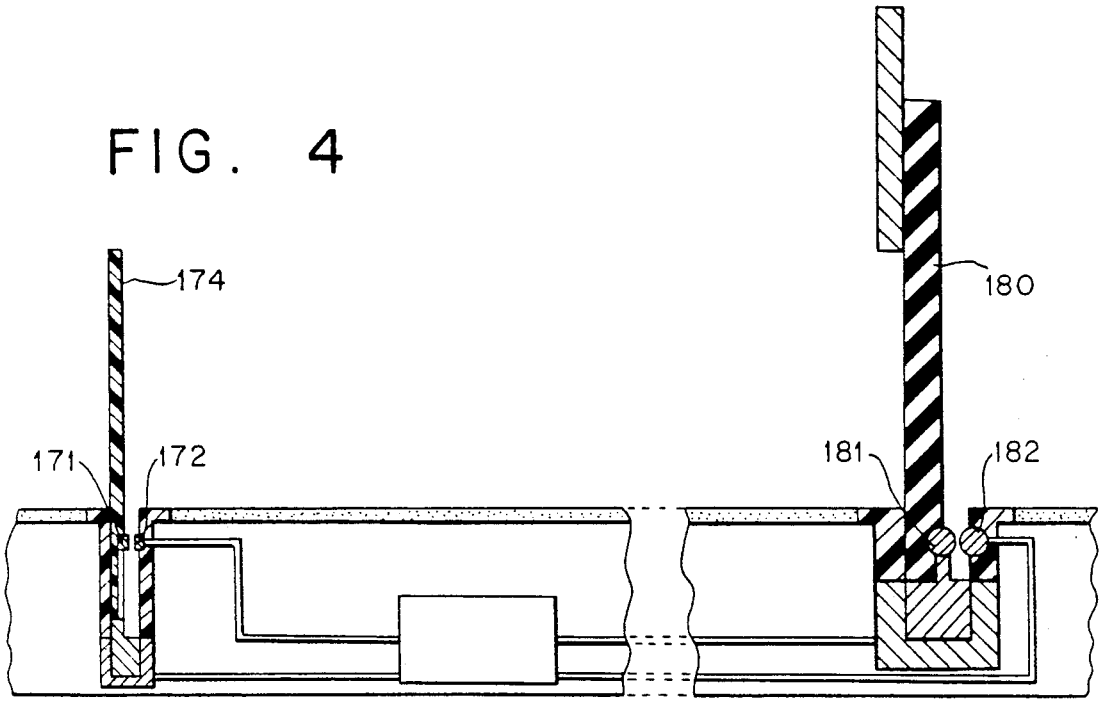
FIG. 4 is a cross-sectional view taken along lines 4—4 of FIG. 3.
Figure 3:
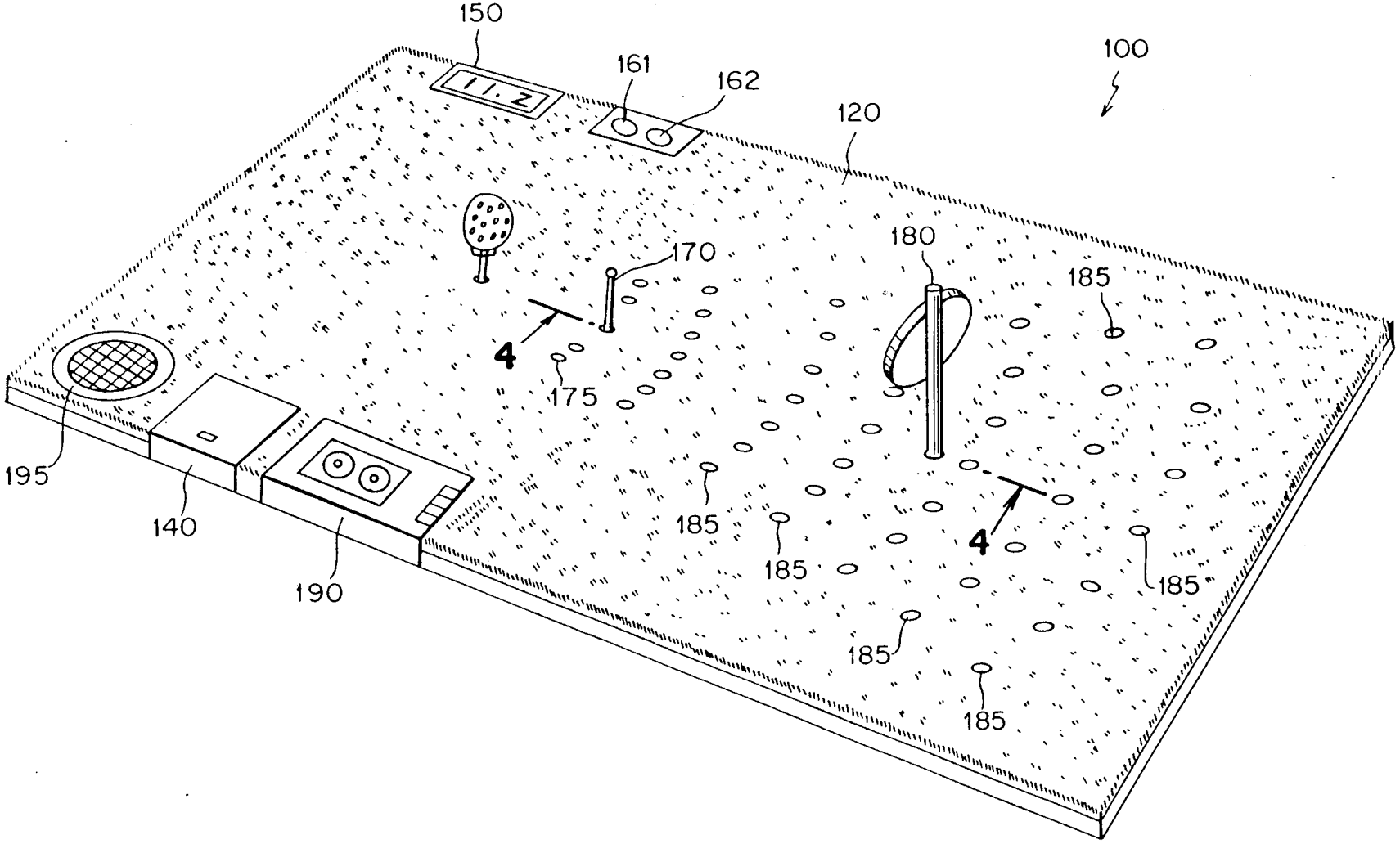
FIG. 3 is a perspective view of another embodiment of the present invention.

An alternative embodiment of the present invention is illustrated in FIGS. 3 and 4. In a manner similar to the instructional golf mat 10 described above, instructional golf mat 100 comprises a ball support 130, a visual indicator 160, a power source 140 and a timer 150. Visual indicator 160 is provided with two light sources, wherein the forwardly positioned light source 161 advantageously operates in a manner similar to the light in indicator 60 described above.

Instructional mat 100 is also provided with two detectors for determining the speed of a clubhead during the golfer's backswing. Forward detector 170 is preferably, movably positioned slightly rearwardly of ball support 130 at a distance sufficient to allow a golfer to readily place a clubhead between ball support 130 and forward detector 170 while taking his stance and without contacting forward detector 170. The upper portion of forward detector 170 comprises a durable, relatively thin filament 174 which is attached to a simple switch having contacts 171 and 172 in hole 175. Forward detector 170 is simply constructed and designed to provide an electrical signal when thin filament 174 is contacted with a rearwardly moving clubhead during a backswing.

As illustrated, a rearward detector 180 is movably disposed within a receptor 185 a predetermined distance from forward detector 170. The arrangement of rearward detector 180 in a receptacle 185 is also designed with electrical contacts 181, 182 to provide an electrical signal when rearward detector 180 is contacted with a clubhead during a backswing. Those skilled in the art will appreciate that different types of detectors may be utilized without departing from the scope of the present invention. For example, some other type of motion detector or metal detector may be suitable for determining the position of a clubhead over a portion of mat 120 or for signaling contact with a clubhead, and transmitting a signal in response thereto.

As illustrated in phantom in FIG. 3, the forward detector 170 and rearward detector 180 are in electrical communication with power source 140, timer 150, and visual indicator 160. This electrical circuit is designed such that during a golfer's backswing, timer 150 determines the length of time that it takes for a clubhead to travel between forward detector 170 and rearward detector 180 thereby measuring the speed of the clubhead in the initial part of the golfer's backswing. Those skilled in the art will appreciate that the swing of many golfers may be improved by starting the swing with a slower backswing.

Those skilled in the art will also appreciate that forward detector 170 and rearward detector 180 may also be pivotally mounted within detector receptacles 175, 185 respectively. In this manner, after a clubhead has contacted these detectors on a backswing, these detectors will pivot downwardly and remain outside the club path during the forward travel of the clubhead. In this manner, the potential for distraction to the golfer during the execution of his swing is minimized by reducing the number of contacts between the clubhead and these detectors.

As illustrated in FIG. 3, mat 120 is advantageously provided with at least three holes 175 to allow the golfer to selectively position forward detector 170 at different locations on mat 120. Similarly, a plurality of receptacles 185 are arranged in a number of rows and at varying distances from the longitudinal axis of the mat for selective positioning of rearward detector 180. Those skilled in the art will appreciate that a golfer may wish to practice a swing wherein the clubhead does not travel directly down the center of the mat.

According to this embodiment of the present invention, rearward detector 180 may be operatively positioned within any of receptacles 185. A plurality of rearward detectors 180 having different lengths may also be provided allowing a golfer to vary the arch of his backswing.

In the embodiment of the present invention illustrated in FIG. 3, visual indicator 160 comprises at least two lights, a forward light 161 and a rearward light 162. Timer 150 can be set such that rearward light 162 having one color, for example green, will only be illuminated if the time period between contact of the clubhead and the two detectors is sufficiently long. In other words visual indicator 162 will only be eliminated if the golfer's backswing is sufficiently slow. If the backswing is to rapid, the golfer will not receive the positive reinforcement of illuminated signal indicator 162 and will realize that the initial part of his swing is faulty.

According to this embodiment of the present invention, when the golfer executes his down-swing and contacts ball support 130 a signal is transmitted which extinguishes light 162 and commences the predetermined time period for illumination of light 161 which may be a different color, for example, red. Therefore, it will be appreciated that the embodiment of the present invention illustrated in FIG. 3 provides biofeedback to a golfer during his swing which will train the golfer to execute a properly paced backswing and to keep his eyes focused on the tee area thereby refraining from raising his head to early in his swing.

While the visual indicators described above are the preferred manner of providing biofeedback to the golfer, it will be appreciated by those skilled in the art that audible signals may also be provided to the golfer as an indication of the successful or unsuccessful execution of a portion of his swing. For example, if the golfer executes his backswing too rapidly, a buzzer might be provided to indicate a faulty backswing. While such other indicators might be utilized within the scope of the present invention, the more subtle use of one or more lights is presently the preferred mode of providing an indication to the golfer.

Also illustrated in FIG. 3 is an optional information play back device in the form of a tape recorder 190. This play back device may be adapted to play any desired information storage medium such as a cassette tape, video tape, or compact disc, which might be used by the golfer to broadcast a pre-recorded golf lesson while the golfer is using instructional golf device 100.

While the preferred power supply of the present invention is a battery which enables the illustrated embodiments to be readily transported for outdoor use, the power supply may be in the form of an electrical cord for charging a rechargeable battery and/or for directly supplying alternating current to the instructional golf device.

While the present invention has been illustrated in the form of an instructional golf mat, according to an alternative embodiment of the present invention the ball support, which merely serves as a moveable switch element, the indicator, timer, and power source, may be essentially separate pieces joined only by electrical leads. In other words, the incorporation of the operative elements of the present invention in to a single mat is not essential in order to obtain the benefits of the present invention.

WHAT IS CLAIMED IS:

1. An instructional ball hitting device comprising:
a moveable switch element;
a power supply;
an indicator having an activated mode and a non-activated mode;
a timer arranged in electrical communication with said switch element, said power supply, and said indicator whereby said indicator is activated for a predetermined time period in response to movement of said switch element in response to the movement of an athletic implement during execution of a swing by an athlete.

2. An instructional ball hitting device according to claim 1 wherein said indicator comprises a visual indicator.

3. An instructional ball hitting device according to claim 2 comprises a light.

4. An instructional ball hitting device according to claim 3 wherein said light blinks when in said activated mode.

5. An instructional ball hitting device according to claim 1 wherein said indicator comprises an audible indicator.

6. An instructional ball hitting device according to claim 1 wherein said switch element, said indicator, said timer, and said power supply are arranged in a unitary mat.

7. An instructional ball hitting device according to claim 1 further comprising a forward detector and a rearward detector;
said forward detector and rearward detector arranged in electrical communication with said power supply, said timer, and said indicator;
said forward detector providing a first signal to said timer in response to contact of a clubhead with said forward detector;
said rearward detector providing a second signal to said timer in response to contact of a clubhead with said rearward detector; and
whereby said timer measures the time between said first signal and said second signal.

8. An instructional ball hitting device according to claim 7 wherein said timer activates said indicator if the time period between said first signal and said second signal is greater than a predetermined time period.

9. An instructional ball hitting device according to claim 8 wherein said switch element, said indicator, said timer, and said power supply are arranged in a unitary mat.

10. An instructional ball hitting device according to claim 9 further comprising means for broadcasting information from a pre-recorded information storage device.

11. An instructional golf device comprising:
a power supply;
a timer;
an indicator having an activated mode and a non-activated mode;
a forward detector and a rearward detector;
said forward detector and rearward detector arranged in electrical communication with said power supply, said timer, and said indicator;
said forward detector providing a first signal to said timer in response to contact of a clubhead with said forward detector;
said rearward detector providing a second signal to said timer in response to contact of a clubhead with said rearward detector;
means for enabling said timer to measure the time between said first signal and said second signal;
and means to actuate said indicator in response to a signal from said timer.

12. An instructional golf device according to claim 11 wherein said timer activates said indicator if the time period between said first signal and said second signal is greater than a predetermined time period.

13. An instructional golf device according to claim 12 wherein said switch element, said indicator, said timer, and said power supply are arranged in a unitary mat.

14. An instructional golf mat according to claim 11 wherein said ball support comprises a moveable switch element; and
wherein said indicator is activated for a predetermined time period in response to movement of said switch element.

15. An instructional golf device according to claim 11 wherein said indicator comprises a visual indicator.

16. An instructional golf device according to claim 15 comprises a light.

17. An instructional golf device according to claim 16 wherein said light blinks when in said activated mode.

18. An instructional golf device according to claim 11 further comprising an information play back device.

* * * * *